US005531656A

United States Patent [19]

Varghese

[11] Patent Number: 5,531,656

[45] Date of Patent: Jul. 2, 1996

[54] PORTABLE BABY SWING

[76] Inventor: John K. Varghese, 46 Ellmyer Rd., Edison, N.J. 08820

[21] Appl. No.: 402,890

[22] Filed: Mar. 1, 1995

[51] Int. Cl.[6] ..... A63B 22/00

[52] U.S. Cl. ..... 482/69; 482/43; 472/118; 297/274

[58] Field of Search ..... 482/25, 38, 43, 482/69; 472/118, 121; 297/274; 5/98.3; 403/109

[56] References Cited

U.S. PATENT DOCUMENTS

| | | | |
|---|---|---|---|
| 2,475,927 | 7/1949 | Verderber | 403/109 |
| 2,899,204 | 8/1959 | Ratay | 402/38 |
| 4,948,120 | 8/1990 | Krueger et al. | 297/274 |
| 5,097,545 | 3/1992 | Hooi | 297/274 |

FOREIGN PATENT DOCUMENTS

| | | | |
|---|---|---|---|
| 2534815 | 4/1984 | France | 482/38 |

*Primary Examiner*—Lynne A. Reichard

[57] ABSTRACT

The portable baby swing of the invention is arranged for the ease of transport and storage, to include a support shaft having first and second sets of telescoping leg sections extensible at opposed ends therefrom, with third and fourth telescoping leg sections pivotally mounted about the support shaft adjacent respective first and second leg sections, with strap structure arranged to secure the sections together when the telescoping legs of each telescoping leg section are extended. The support swing structure provides for a flexible bag member having support straps extending therefrom about the support shaft.

1 Claim, 3 Drawing Sheets

PORTABLE BABY SWING

TECHNICAL FIELD

The field of invention relates to baby swing structure, and more particularly to a portable baby swing wherein the same is directed to the ease of erection of a swing structure for supporting an infant.

BACKGROUND OF THE INVENTION

Prior art baby swing structure as known is directed and exemplified by U.S. Pat. Nos. 4,022,510; 4,375,110; 4,415,200; 5,170,520; and U.S. Pat. No. Des. 326,781.

SUMMARY OF THE INVENTION

The portable baby swing of the invention is arranged for the ease of transport and storage, to include a support shaft having first and second sets of telescoping leg sections extensible at opposed ends therefrom, with third and fourth telescoping leg sections pivotally mounted about the support shaft adjacent respective first and second leg sections, with strap structure arranged to secure the sections together when the telescoping legs of each telescoping leg section are extended. The support swing structure provides for a flexible bag member having support straps extending therefrom about the support shaft.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
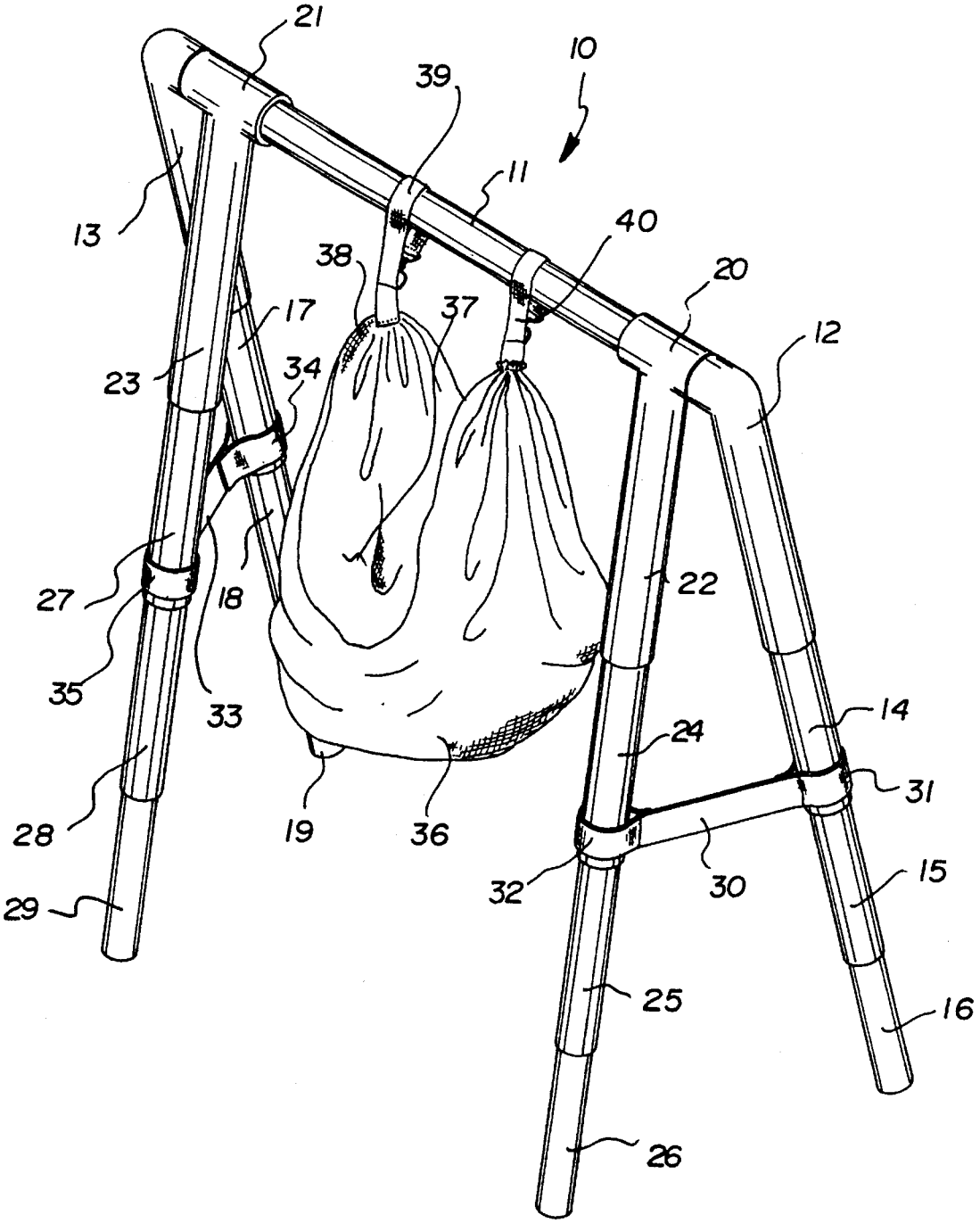
FIG. 1 is a perspective illustration of the invention in an extended orientation.

The portable baby swing 10 of the invention, as indicated in FIG. 1, includes a support shaft 11 of rigid construction having spaced first and second ends rotating thereon respective first and second telescoping leg sections, having respective shaft first and second tubes 12 and 13 obliquely and fixedly secured to the first and second ends of the support shaft, such that the shaft first tube 12 of the first telescoping leg section employs a first tube first leg 14 telescopingly received within the shaft first tube 12, a first tube second leg 15 telescopingly received within the first tube first leg 14, and a first tube third leg 16 telescopingly received within the first tube second leg 15. In a like manner, the second telescoping leg section having the shaft second tube 13 includes a second tube first leg 17 telescopingly received within the shaft second tube 13, a second tube second leg 18 telescopingly received within the second tube first leg 17, and a second tube third leg 19 telescopingly received within the second tube second leg 18. It should be understood that each of the sections employs a typical like manner of telescoping legs not limited to three and certainly may be of a greater or lesser number dependent upon desired height to be employed in positioning the support shaft 11 above an underlying support surface.

Figure 6:
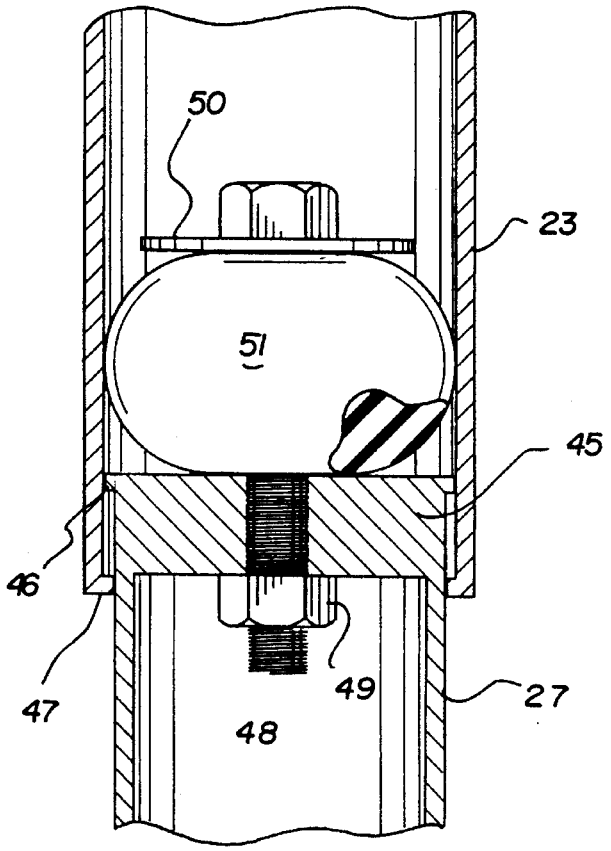
FIG. 6 is an enlarged cross-sectional view, taken along the lines 6—6 of FIG. 3 as indicated.

The respective third and fourth telescoping leg sections employ respective first and second pivot tubes 20 and 21 pivotally mounted about the support shaft 11 adjacent the respective shaft first and second tubes 12 and 13. The first pivot tube 20 having a first pivot tube shaft 22 extending orthogonally from the first pivot tube 20, with a second pivot tube shaft 23 extending orthogonally from the second pivot tube 21. The first pivot tube shaft 22 having a first pivot tube first leg 24 telescopingly received therewithin, with a first pivot tube second leg 25 telescopingly received within the first pivot tube first leg 24, and a first pivot tube third leg 26 telescopingly received within the first pivot tube second leg 25. In a like manner, a second pivot tube first leg 27 is telescopingly received within the second pivot tube shaft 23, a second pivot tube second leg 28 telescopingly received within the, second pivot tube first leg 27, and a second pivot tube third leg 29 telescopingly received within the second pivot tube second leg 28. Each telescoping leg of each of the telescoping leg sections is arranged to be secured in a telescoping relationship and various mechanical expedience may be employed permitting the telescoping relationship of the various legs, with such relationship indicated in FIG. 6 relative to each of the telescoping leg portions. To this end and by means of example, the second pivot tube shaft 23 telescopingly receiving the second pivot tube first leg 27 is arranged with a slide leg end wall 45 fixed to the telescoping leg 27 and the slide leg end wall 45 having a slide leg flange 46 extending therefrom to engage a receiving tube flange 47 of the associated leg it telescopes from and in this instance, the second pivot tube shaft 23. A support rod 48 extends through the end wall 45 extending therebeyond within the second pivot tube shaft 23 terminating in a support rod head plate 50 capturing a resilient body 51 between the head plate 50 and the flange 46, such that upon compression of the head plate 50 towards the flange 47 the resilient body 51 is compressed to engage the interior of the shaft 23. Such tension is adjustable by rotation of a fastener 49 that upon torquing projects the flange 45 and the head plate 50 together, as indicated in FIG. 6.

Figure 2:
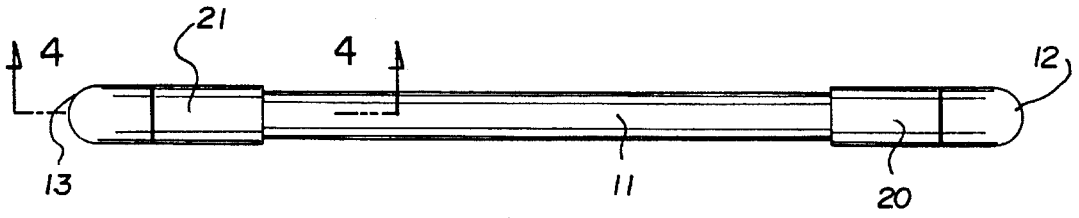
FIG. 2 is a top plan view of the shaft and telescoping leg sections in a collapsed configuration.
Figure 3:
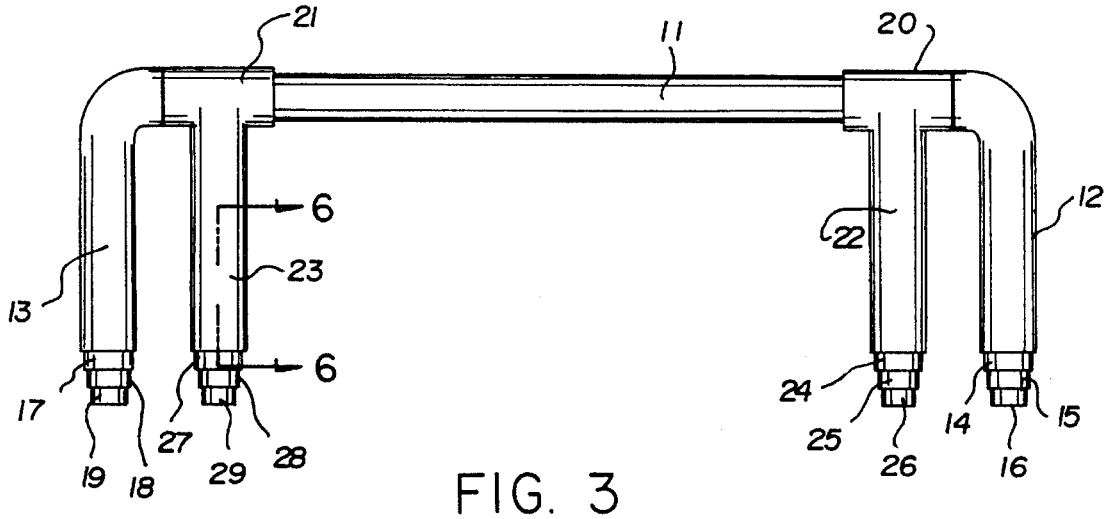
FIG. 3 is a frontal elevational view indicating the telescoping leg sections in a collapsed orientation relative to one another.
Figure 4:
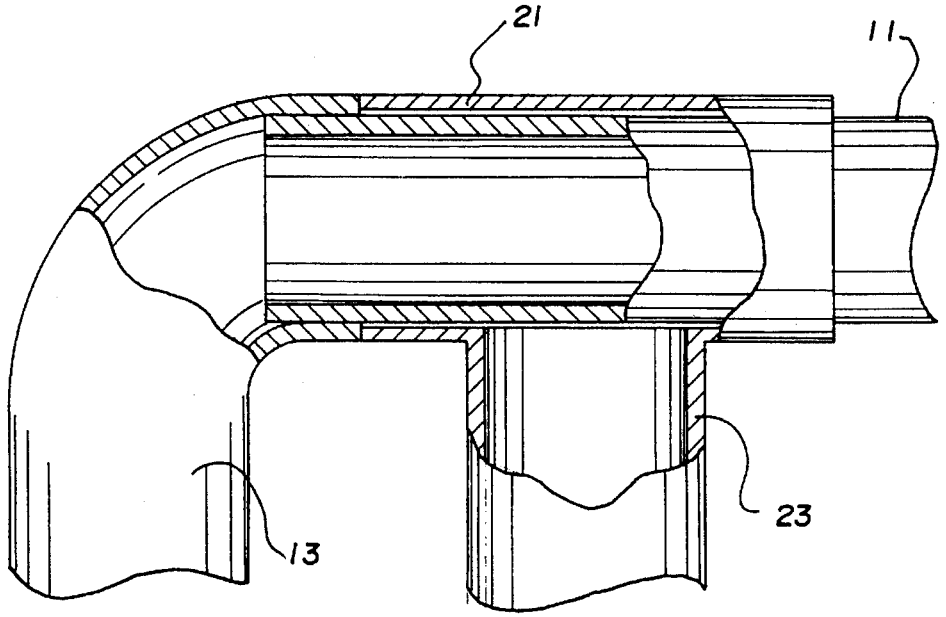
FIG. 4 is an enlarged cross-sectional view, taken along the lines 4—4 of FIG. 2 as indicated.
Figure 5:
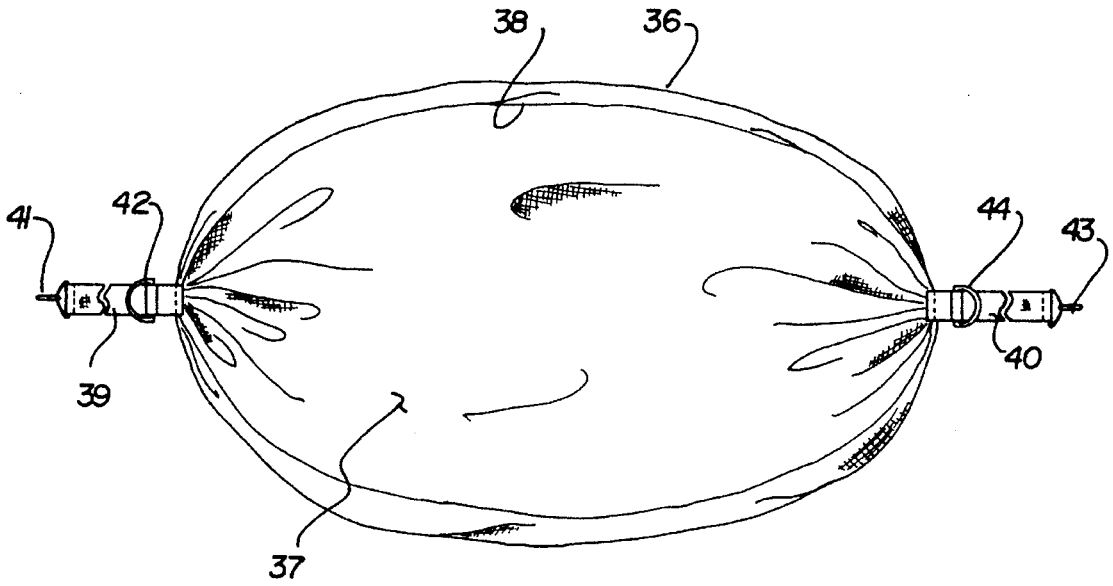
FIG. 5 is a top plan view of the bag member.

The invention, as indicated in the FIGS. 2 and 3, is in a collapsed configuration to promote ease of storage and transport of the device during periods of non-use. During extension of each of the telescoping leg sections, as indicated in FIG. 1, spacing of the first and third, and second and fourth telescoping leg sections is effected by respective first and second plates 30 and 33. The first plate having respective first plate first and second straps 31 and 32 at each end of the first plate 30, with the second plate 33 having respective second plate first and second straps 34 and 35 at each end of the second plate 33. Each of the first and second straps 31, 32, 34, and 35 employ cooperative hook and loop fastener structure permitting engagement of each respective strap relative to an associated telescoping rod member and thereby maintaining the first and third, as well as the second and fourth telescoping leg sections in a predetermined pivoted relationship relative to one another, as illustrated in FIG. 1.

The bag member 36 is employed by the invention to receive an infant therewithin and permits the cradling of an infant in a secure manner, with the bag member 36 having a cavity 37 to this end to receive such infant. The bag member 36 terminates in a peripheral edge 38, such that respective first and second support straps 39 and 40 extend from diametrically opposed positions at the peripheral edge 38, with the first strap 39 having a first strap latch 41 to engage a first strap latch loop 42 upon surrounding the support shaft 11, as indicated in FIG. 1, and similarly, the second support strap 40 having second latch and loop members 43 and 44 respectively to surroundingly engage the support shaft 11 permitting the straps to pivot about the support shaft and thereby pivot the bag member 36 relative to the support shaft 11.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A portable baby swing, comprising, a support shaft, the support shaft having a shaft first end spaced from a shaft second end, with the shaft first end having fixedly secured thereto a first telescoping leg section, and the shaft second end having secured thereto a second telescoping leg section, a third telescoping leg section is pivotally mounted relative to the support shaft adjacent the first telescoping leg section, and a fourth telescoping leg section is pivotally mounted about the support shaft adjacent to the second telescoping leg section, each said telescoping leg section having a plurality of leg members telescopingly received relative to one another, and a first strap means for securing selectively the first telescoping leg section and the third telescoping leg section together, and second strap means for selectively securing the second telescoping leg section and the fourth telescoping leg section together, and swing means removably mountable relative to the support shaft for receiving a child therewithin, the swing means comprises, a bag member of flexible construction, having a cavity therewithin arranged in a facing relationship relative to the support shaft, and the bag member having a peripheral edge and an entrance to said cavity, and a first support strap and a second support strap secured to the peripheral edge of diametrically opposed orientations relative to the peripheral edge, and the first support strap having first latch means for securing the first support strap about the support shaft, and the second support strap having second latch means for securing the second support strap about the support shaft, the first strap means comprising a first rigid plate, and the second strap means comprising a second rigid plate, the first rigid plate having a first plate first strap and a first plate second strap secured at opposed ends of the first plate, with the first plate first strap and the first plate second strap arranged for securement about the first telescoping leg section and the third telescoping leg section respectively, the second plate having a second plate first strap and a second plate second strap at opposed ends of the second plate, and the second plate first strap and the second plate second strap arranged for securement about the second telescoping leg section and the fourth telescoping leg section respectively.

* * * * *